United States Patent [19]

Nilson et al.

[11] Patent Number: 4,730,106

[45] Date of Patent: Mar. 8, 1988

[54] OPTICAL FIDUCIAL TIMING SYSTEM FOR X-RAY STREAK CAMERAS WITH ALUMINUM COATED OPTICAL FIBER ENDS

[75] Inventors: David G. Nilson, Oakland; E. Michael Campbell, Pleasanton; Brian J. MacGowan; Hector Medecki, both of Livermore, all of Calif.

[73] Assignee: United States Department of Energy, Washington, D.C.

[21] Appl. No.: 937,792

[22] Filed: Dec. 4, 1986

[51] Int. Cl.[4] ..... H01J 31/50; H01J 40/14

[52] U.S. Cl. ..... 250/213 VT; 378/99; 350/96.15; 350/96.17; 350/96.20; 313/372

[58] Field of Search ..... 313/371, 372, 524, 475; 250/213 VT, 423 P; 350/96.15, 96.17, 96.20, 96.21, 96.24, 96.25, 96.26, 96.27, 96.29, 96.30, 96.34; 378/99

[56] References Cited

U.S. PATENT DOCUMENTS

| | | | |
|---|---|---|---|
| 4,028,080 | 6/1977 | Di Vita et al. | 350/96.3 |
| 4,259,609 | 3/1981 | Month et al. | 313/372 |
| 4,264,408 | 4/1981 | Benham | 313/372 |
| 4,362,933 | 12/1982 | Kroener et al. | 250/213 VT |
| 4,542,290 | 9/1985 | Tan et al. | 250/213 VT |

FOREIGN PATENT DOCUMENTS

| | | | |
|---|---|---|---|
| 0044948 | 3/1982 | Japan | 313/371 |

OTHER PUBLICATIONS

D. G. Nilson and B. J. MacGowan, "Green Light 2ω as an X-Ray Streak Camera Fiducial," Rev. Sci. Instrum. 57(8), 8/86, pp. 2187–2188.

D. G. Nilson and B. J. MacGowan, "Green Light 2ω as an X-Ray Streak Camera Fiducial," Abstract distributed, 3/86.

Graves et al., "Nova Optical Fiducial System", 1984 Laser Program Annual Report, Lawrence Livermore National Laboratory, 6/85, pp. 5-91 to 5-94.

*Primary Examiner*—David C. Nelms
*Assistant Examiner*—Michael Messinger
*Attorney, Agent, or Firm*—Gary C. Roth; Clifton F. Clouse, Jr.; Judson R. Hightower

[57] ABSTRACT

An optical fiducial timing system is provided for use with interdependent groups of X-ray streak cameras (18). The aluminum coated (80) ends of optical fibers (78) are positioned with the photocathodes (20, 60, 70) of the X-ray streak cameras (18). The other ends of the optical fibers (78) are placed together in a bundled array (90). A fiducial optical signal (96), that is comprised of 2ω or 1ω laser light, after introduction to the bundled array (90), travels to the aluminum coated (82) optical fiber ends and ejects quantities of electrons (84) that are recorded on the data recording media (52) of the X-ray streak cameras (18). Since both 2ω and 1ω laser light can travel long distances in optical fiber with only a slight attenuation, the initial arial power density of the fiducial optical signal (96) is well below the damage threshold of the fused silica or other material that comprises the optical fibers (78, 90). Thus the fiducial timing system can be repeatably used over long durations of time.

12 Claims, 7 Drawing Figures

OPTICAL FIDUCIAL TIMING SYSTEM FOR X-RAY STREAK CAMERAS WITH ALUMINUM COATED OPTICAL FIBER ENDS

The United States Government has rights in this invention pursuant to Contract No. W-7405-ENG-48 between the U.S. Department of Energy and the University of California for the operation of the Lawrence Livermore National Laboratory.

BACKGROUND OF THE INVENTION

The invention described herein relates generally to fiducial timing systems for use with interdependent groups of streak cameras, and more particularly to optical fiducial timing systems for use with interdependent groups of streak cameras, especially X-ray streak cameras.

In recent years it has developed that various short duration and rapidly changing phenomena related to plasma physics may be conveniently and accurately recorded by using streak cameras to measure X-ray and/or optical plasma emissions. This has given rise to the construction of large systems of interdependent streak cameras that are designed to measure the salient features, in terms of spectral energy range, intensity, pulse shape and the like, of plasma event experiments. For example, the Nova Laser Facility of the Lawrence Livermore National Laboratory, which presently is a 100-TW/100-kJ-class laser system comprising ten 137-meter-long neodymium glass laser chains that are used to study inertial confinement fusion and other aspects of plasma physics, has such a streak camera diagnostic system surrounding disposed about a target chamber which is 4.4 meters in diameter. Many analogous research facilities, both in the United States and throughout the world, have very extensive, associated streak camera diagnostic systems for the recordation of experimental results.

At these facilities, after an experiment is performed, it would be extremely beneficial to have accurate and absolute reference timing information available for each streak camera data record, so that all the data records could be temporally compared. The reason for this is that the pulsed radiative emissions from a plasma, such as the plasma produced when an inertial confinement fusion target is laser driven, is invariably highly functional of both radiation frequency and emission direction. Thus, for example, if one were given, without timing information, two related streak camera data records that were taken over different radiation frequency ranges, or even over the same radiation frequency range, but in different spatial directions with respect to the emitting source, the records generally could not be temporally cross-compared by simple visual inspection. It is emphasized that this is not a problem of the data records simply having been taken at different sweep rates, as measured, for example, in millimeters per picosecond; it is, rather, a problem of not being able to establish, for each sweep camera data record, an absolute system time for each position along each separate data record.

The problem of how to cross-time the data from a multiplicity of diagnostic instruments that are all recording signals emitted from the same source is not new. The usual solution is to create a single fiducial signal, send it to each recording instrument along separate paths of known time delay, and then record it on each diagnostic instrument along with the normally measured data. Even though recorded together on the same piece of photographic recording film or on the same oscilloscope trace, to give typical examples of recording media, the fiducial signal and the recorded data are usually arranged to be separated in time when recorded, so as not to interfere with one another. By knowing or measuring the time it takes for the single fiducial signal to travel along the various paths to each recording instrument, and the location at which the fiducial signal appears on each data record, one is enabled to associate the fiducial signal appearing on each data record with an individual and known point of time. Thus, the individual data from all the recording instruments may be cross-compared accurately.

In many fiducial timing systems the fiducial signal interacts with each recording instrument by the same physical mechanism as the data signal that the recording instrument is recording. Thus each signal is recorded in sequence at its appropriate time. For example, if a voltage data signal is being recorded by a voltage recording instrument, a fiducial signal in the form of a short voltage pulse is often input to the instrument. On the other hand, if an optical signal is being recorded by an optical recording instrument, then a fiducial signal in the form of a short burst or pulse of light may be directly input to the optical recording instrument at the appropriate time. If this direct approach is not possible or convenient, some other means must be employed whereby the fiducial signal will cause its signature to be impressed on the recording medium at the unique location indicative of fiducial signal time. That is, means must be employed whereby, as the recording instrument writes or otherwise establishes a data record across a data recording medium, the recording instrument will write or record the signature of the fiducial signal on the recording medium at the time when, or as, the fiducial signal arrives at the recording instrument, and at the location on the recording medium where data are then being recorded.

To give a practical example, in many sweep camera data recording instruments a data record is established on a photographic film recording medium when a pulse of electrons is accelerated, focused, and swept across a phosphor screen. Data are recorded in the form of exposure level variations along the exposed path on the film, because the input data signal proportionally controls the instantaneous intensity of the sweeping electrons. In fact, at the times when there is no data signal, the instantaneous intensity of the sweeping electron pulse is zero. Additionally, by employing various slit configurations in the sweep camera, the sweeping electron pulse can be caused to have a transverse structure indicative of the spatial characteristics of the driving source. In these sweep camera data recording instruments, means should be employed to cause a fiducial signal to be recorded on the surface of the film at an appropriate location. In situations where optical streak cameras are recording visible optical data signals, it is relatively easy to arrange for a visible optical fiducial signal to cause a pulsed excursion in intensity in the sweeping electrons. However, in situations where X-ray streak cameras are recording X-ray signals, it is not practical to provide X-ray fiducial signals having sufficient X-ray intensity to be recorded by the cameras. Additionally, in these situations, it is also presently not practical to use non-X-ray fiducial signals to cause X-ray streak cameras to undergo pulsed excursions in sweeping electron pulse intensity. The reasons for this will now be examined.

Reference is made to FIG. 1, prior art, which is a schematic representation of a diagnostic system that includes an X-ray streak camera. A pulsed X-ray source 10 is positioned within the evacuated interior of a housing 12 that is provided with a slit or hole 14 through which a quantity of X-rays 16, emitted from source 10, may pass. An X-ray streak camera 18, the interior of which is evacuated by means not shown, is positioned adjacent to housing 12 so as to receive X-rays 16. X-rays 16 directly impinge upon an X-ray streak camera photocathode 20, within an end surface 21, thereby causing the ejection of electrons from photocathode 20. In actual practice photocathode 20 may have many different configurations and shapes. Photocathode 20 and end surface 21 are shown supported by a photocathode fixture 22 that is, in turn, inserted into a mounting member 24. Mounting member 24 is supported by a photocathode support structure 26 that is attached to an X-ray streak camera housing 28. A schematic cut-away view of photocathode 20, end surface 21, and photocathode fixture 22 is given in FIG. 2, prior art. Returning to FIG. 1, electrons ejected from photocathode 20, by X-rays 16, are accelerated toward an accelerating grid 30, that is caused to be at a positive electrical potential with respect to photocathode 20, by well-known means that are not shown. Grid 30 is supported within mounting member 24. The accelerated electrons are focused into an electron pulse 32 by a focusing electrode 34 that is supported by a focusing electrode support structure 36 that is attached to streak camera housing 28. Electron pulse 32 is continuously swept from a first election path 38 to a final electron path 40 by means of a pair of sweep plates 42, that are held within X-ray streak camera housing 28 by a pair of support rods 44. The means by which an electron pulse is spatially swept by sweep plates are very well-known in the prior art. Since the number of electrons being ejected from photocathode 20 is instantaneously proportional to the intensity of X-ray quantity 16, the intensity of electron pulse 32 is also instantaneously proportional to the intensity of X-ray quantity 16. Electron pulse 32 sweeps across a microchannel plate 46 and a phosphor coated fiber optic faceplate 48, disposed in an image intensifier housing 50, and produces photons that are recorded on film 52, contained in film housing 54.

In operation, X-ray streak camera 18 is triggered, by well-known means that are not shown, so that electron pulse 32 will sweep between paths 38 and 40 as X-ray source 10 emits a short burst or pulse of X-rays, of which X-ray quantity 16 impinges on photocathode 20. When photographic film 52 is developed, an intensity-varying streak of data indicative of the time-varying character of X-ray quantity 16 is revealed. Absolute system timing is totally lacking from this data record. As mentioned above, it is presently not practically feasible to create a fiducial pulse of X-rays having a sufficient intensity to be recorded on photographic film 52.

However, as indicated in FIG. 3, prior art, to whicn attention is now directed, it has been attempted to use an optical, not an X-ray, fiducial signal to drive the data recording mechanism of X-ray streak cameras. FIG. 3 is a sectional side view of a photocathode 60, an end surface 62, and a photocathode fixture 64 of an X-ray streak camera similar to the X-ray streak camera of FIGS. 1 and 2. The prior attempt comprised trying to use an optical pulse of light to produce electrons. An optical light-conducting fiber 66 was inserted through a hole 68 in end surface 62, with hole 68 positioned near photocathode 20, as shown. The attempt was made to send an intense pulse of light along optical fiber 66 having sufficient light intensity to produce a burst of electrons that could be recorded by an X-ray streak camera. The mechanism of electron production in this attempt was to have the light directly interact with optical fiber 66 itself, particularly at impurity sites, and eject electrons therefrom. This attempt substantially failed because bursts or pulses of optical light having an intensity sufficient to produce enough electrons from the end of optical fiber 66 to be sensibly recorded on the film of a streak camera are likewise sufficiently intense to cause serious damage to fiber 66, so that fiber 66 usually cannot be used more than once and has to be replaced after each use. This means that an optical fiducial timing system of this type would have to be totally replaced after each experiment. In diagnostic systems comprising many X-ray streak cameras, this is intolerable.

SUMMARY OF THE INVENTION

It is, therefore, an object of the invention to provide an optical fiducial timing system for use with interdependent groups of streak cameras, particularly including X-ray streak cameras.

Another object of the invention is to provide such an optical fiducial timing system that may be repetitively and dependably used for long periods of time.

Yet another object of the invention is to provide such an optical fiducial timing system that produces a fiducial pulse record, or signature, of extremely short temporal duration, on X-ray streak camera data records.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, the method and apparatus of this invention may comprise an optical fiducial timing system in which a single fiducial optical signal records an individual fiducial optical data record onto the individual data recording medium of each of one or more interdependent X-ray streak cameras. The single fiducial optical signal may also be used to provide fiducial system timing to non-X-ray streak cameras in accordance with methods that are known in the prior art. Each X-ray streak camera has an X-ray photocathode from which, during operation, an X-ray beam ejects photoelectrons that are formed into a photoelectron pulse that records an X-ray data record onto the data recording medium. The optical fiducial timing system comprises a group of optical fibers, one fiber for each X-ray streak camera. An end of each optical fiber is coated with a layer of aluminum. Preferably each optical fiber is comprised of fused silica and is approximately 100 microns in diameter. Each aluminum layer coating preferably has a thickness in the approximate range from 50 to 200 Angstroms. The aluminum coated optical fiber ends are individually positioned, one in each X-ray streak camera, at the location within each X-ray streak camera where the ejected photoelectrons begin to be formed into a photoelectron pulse. Any additional electrons introduced into one of these locations will likewise be formed into an electron pulse and recorded on the data recording medium of that X-ray streak camera. The ends of the optical fibers that are not aluminum coated are placed together into a bundled array that permits a single optical signal to be commonly introduced into each of the uncoated optical fiber ends. During operation of the X-ray streak cameras, the optical fiducial timing system functions when a single fiducial optical signal, preferably comprised of $2\omega$, approximately 0.53 micron laser light, or $1\omega$, approximately 1.06 micron laser light, is commonly introduced through the bundled array into each bare end of the group of optical fibers. The fiducial optical signal travels along each optical fiber, and when it reaches the aluminum layers ejects quantities of electrons therefrom. Preferably, when the fiducial optical signal reaches each aluminum layer it has an arial power density in excess of approximately 100 $MW/cm^2$ for $2\omega$ laser light or 200 $MW/cm^2$ for $1\omega$ laser light. These arial power densities are well below the damage threshold of fused silica optical fibers. The ejected elections are formed into electron pulses, by the normal operating function of each X-ray streak camera, and the electron pulses record individual fiducial optical data records, each related to the single fiducial optical signal, onto the data recording media of the X-ray streak cameras. The electron pulses are of extremely short temporal duration because of the nonlinear character of the interaction of the light, of the fiducial optical signal, with the aluminum layers. Each individual fiducial optical data record is recorded onto its individual data recording medium as the single fiducial optical signal arrives at each X-ray streak camera, and at the location on the individual data recording medium where X-ray data is also then being recorded.

The benefits and advantages of this invention include the provision of an optical fiducial timing system for use with interdependent groups of X-ray, and other, steak cameras, that may be repetitively and dependably used for long periods of time, and that produces fiducial optical data records of extremely short temporal duration.

BRIEF DESCRIPTION OF THE DRAWINGS

The accompanying drawings, which are incorporated in and form part of the specification, illustrate an embodiment of the invention and, together with the description, serve to explain the principles of the invention. In the drawings.

DETAILED DESCRIPTION OF THE INVENTION

Figure 1:
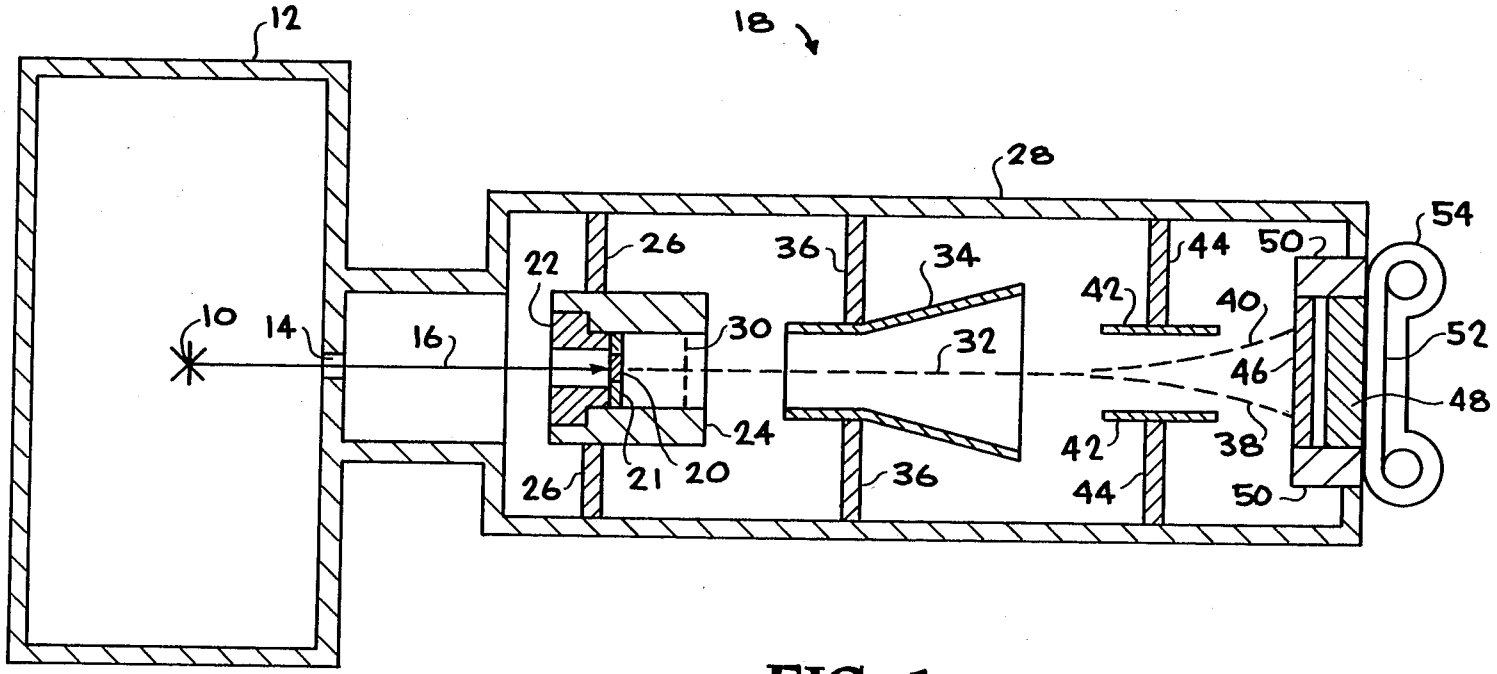
FIG. 1 (PRIOR ART)
FIG. 1, prior art, is a schematic side view of an X-ray diagnostic system that includes an X-ray streak camera.
Figure 2:
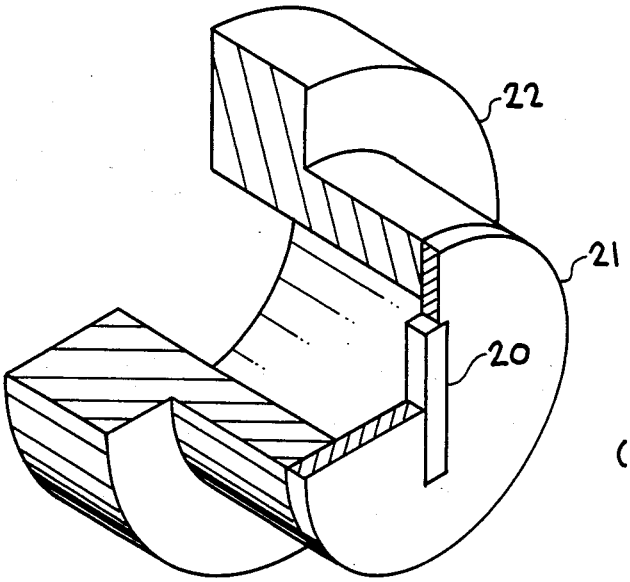
FIG. 2 (PRIOR ART)
FIG. 2, prior art, is a cut-away perspective view of the X-ray photocathode and related structure of the X-ray streak camera of FIG. 1.
Figure 3:
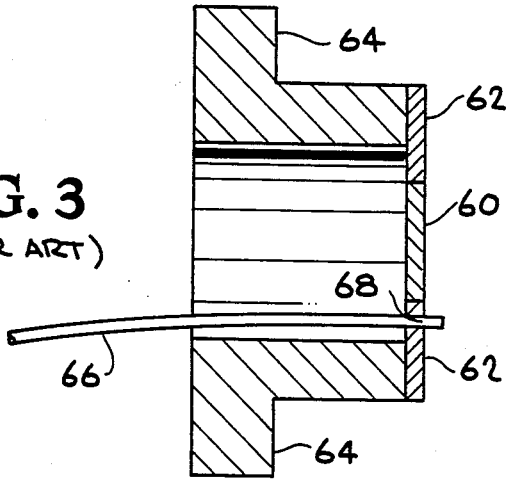
FIG. 3 (PRIOR ART)
FIG. 3, prior art, is a cross-sectional side view of the X-ray photocathode and related structure of an X-ray streak camera similar to that of FIG. 1, further including an optical fiber.

Reference has been made above to FIGS. 1, 2 and 3, prior art, which together show an X-ray diagnostic system including an X-ray streak camera, and illustrate an unsuccessful attempt to use an optial signal to drive the data recording mechanism of the X-ray streak camera. As previously stated, the attempt was unsuccessful because pulses of optical light sufficiently intense to drive electrons from the end of a fairly long optical fiber were also sufficiently intense to cause irreparable damage to the optical fiber itself. This effect will now be considered in more detail. The efficiency of a photon in ejecting electrons from impurity sites in glass is extremely functional of wavelength. Specifically, this efficiency is high at X-ray wavelengths but progressively and rapidly diminishes with longer wavelengths extending into the visible or optical range. Because of this, in attempting to eject electrons from glass with an optical pulse, the optical pulse should be comprised of photons having the shortest wavelength practicably available. As a practical matter, any optical light pulse sufficiently intense to appreciably eject electrons from glass should be provided by a laser. The type of laser most generally available for providing intense pulses of rather short wavelength light is the neodymium glass laser, whose normal wavelength is appoximately 1.06 micron. Unfortunately, light of this wavelength, which is also called $1\omega$ light, is too long in wavelength to appreciably eject electrons from glass by the linear photoelectric effect. However, very well-known harmonic-conversion systems can be used to routinely transform $1\omega$ light into $2\omega$ or $3\omega$ laser light having wavelengths of approximately 0.53 microns or approximately 0.35 microns, respectively. It is to be noted that $3\omega$ light can efficiently eject large quantities of electrons from the impurity sites in glass. However, there is yet another factor to consider: namely the transmission characteristics of laser light in an optical fiber. While $1\omega$ or $2\omega$ laser light can generally travel relatively long distances in an optical fiber without suffering an appreciable attenuation, $3\omega$ laser light is seriously attenuated in traveling even relatively short distances in a glass fiber. Note that the short wavelengths that enable light to more effectively eject electrons, also cause that light to more strongly interact with, and be affected by, the glass or fused silica of the fiber itself. As a specific example, a 30 picosecond, full width at half maximum amplitude, pulse of $3\omega$ laser light traveling only 20 meters through a 100 micron diameter, fused silica optical fiber, is dispersed into a 130 picosecond, full width at half maximum amplitude, pulse and suffers an approximately 80 percent transmission loss. Consequently, $3\omega$ laser light pulses having sufficient intensity to pass through optical fibers of the length practically required by fiducial timing systems, and then eject electrons from the fiber end, must have an initial light intensity above the damage threshold of the fused silica glass of the optical fiber.

Figure 4:
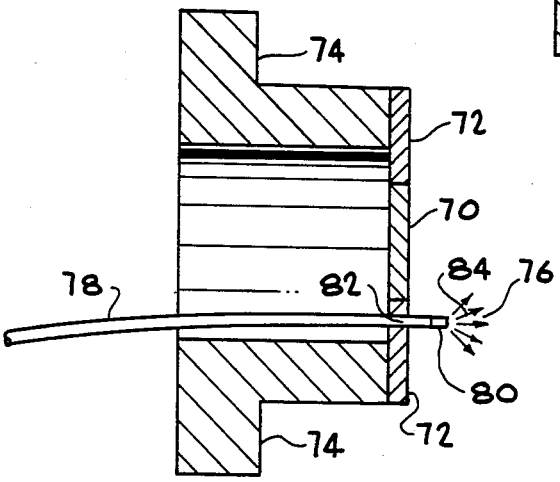
FIG. 4 is a cross-sectioned side view of the X-ray photocathode and related structure of an X-ray streak camera similar to that of FIG. 1, together with an optical fiber having an end coated with a layer of aluminum, with which an optical signal can produce a quantity of electrons, in accordance with the invention.
Figure 5:
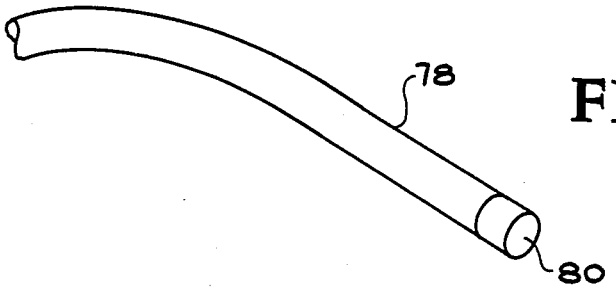
FIG. 5 is a schematic view of the optical fiber having an end coated with a layer of aluminum, of FIG. 4.

Reference will now be made in detail to the present preferred embodiment of the invention, an example of which is illustrated in the accompanying drawings. Reference is now made to FIG. 4 which is a cross-sectioned side view of the X-ray photocathode and related structure of a typical X-ray streak camera. It is emphasized that the present invention is intended for use with one or more interdependent X-ray streak cameras, where each X-ray streak camera has a data recording medium and an X-ray photocathode from which, during operation, X-rays eject photoelectrons that the camera forms into a pulse and records on the data recording medium. Additionally, the optical signal driven timing system of this invention can be used to provide timing information to many, non-X-ray driven data recording instruments, in accordance with technology that is well-known in the electronics and related arts. The X-ray photocathode and related structure of FIG. 4 comprises an X-ray photocathode 70, an end surface 72, and a photocathode fixture 74. A spatial region 76 has the property that any X-ray streak camera associated with the X-ray photocathode structure of FIG. 4 will begin to form any electrons that are injected into spatial region 76 into an electron pulse that will be recorded onto the data recording medium of the X-ray streak camera, as explained above in conjunction with the discussion of the X-ray streak camera of FIG. 1. The apparatus of FIG. 4 is additionally provided with an optical fiber 78, an end of which is positioned into spatial region 76. The end of optical fiber 78, positioned into spatial region 76, is coated with a layer of aluminum 80. Optical fiber 78 and aluminum coating 80 are also shown in FIG. 5. Returning now to FIG. 4, optical fiber 78 is inserted through a hole 82 in end surface 72. It is preferred that optical fiber 78 be comprised of fused silica and be approximately 100 microns in diameter. It is also preferred that aluminum layer 80 have a thickness in the approximate range from 50 to 200 Angstroms.

Figure 6:
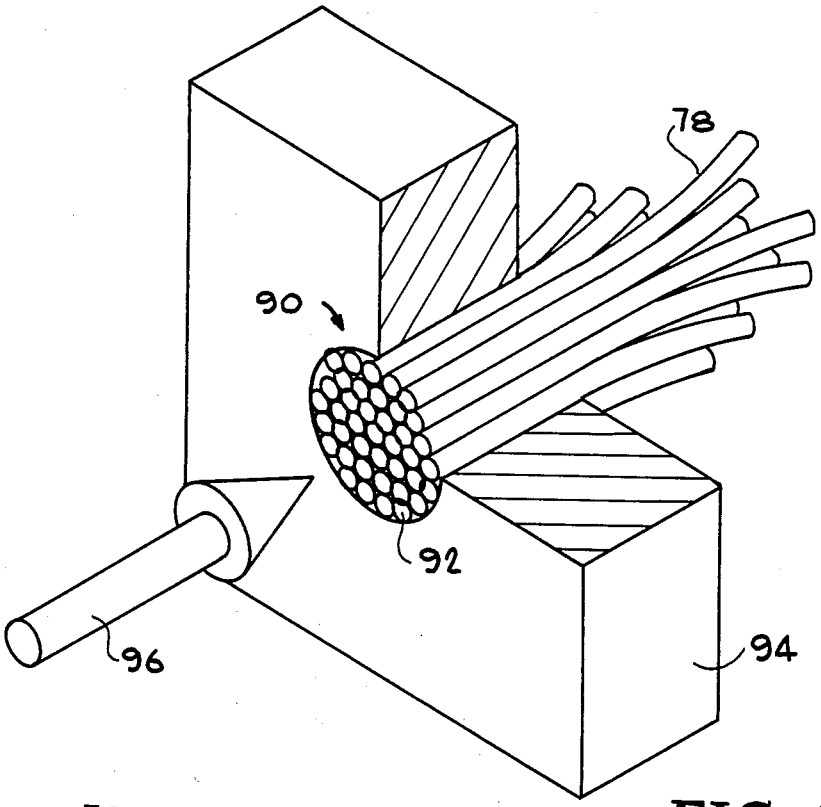
FIG. 6 is a schematic view of a bundled array, formed by the ends of a group of optical fibers, that permits a single optical signal to be commonly introduced into each of the ends of the group of optical fibers, in accordance with the invention.

The ends of the optical fibers, such as fiber 78, that are not coated with aluminum and that are used in the practice of this invention, are placed together into a bundled array 90, as shown in FIG. 6 to which attention is now drawn. Bundled array 90 is held together by placement in a hole 92 in an array plate 94. In preferred embodiments of the invention, hole 92 has a diameter, as shown in FIG. 6, that is approximately 1.2 millimeters. Holes of this size can accommodate approximately sixty-one, 100 micron diameter optical fibers. Optical fiber 78, of FIGS. 4 and 5, is shown as comprising one fiber of bundled array 90 of FIG. 6. Bundled array 90 has the characteristic of permitting single optical signals to be commonly, that is at the same time, introduced into each optical fiber that comprises bundled array 90. This is basically because all the fiber ends comprising bundled array 90 lie on a planar surface, and thus may be accessed at the same time by single optical signals. A single fiducial optical signal 96, that preferably is comprised of $2\omega$, approximately 0.53 micron laser light having an arial power density in excess of approximately 100 $MW/cm^2$, or of $1\omega$ approximately 1.06 micron laser light having an arial power density of approximately 200 $MW/cm^2$, is schematically shown, in FIG. 6, being commonly introduced into bundled array 90. During operation of the X-ray streak cameras of the invention, single fiducial optical signal 96 is introduced into and travels along each optical fiber, such as fiber 78, of bundled array 90, and proceeds to the other ends of the fibers where it strikes each aluminum layer, such as aluminum layer 80 of FIGS. 4 and 5, that terminates each optical fiber. As stated above, both $2\omega$ and $1\omega$ light can travel long distances, such as 20 meters, in an optical fiber without suffering appreciable attenuation. Referring now to FIGS. 4 and 6 together, when the single optical fiducial pulse 96 strikes an aluminum layer such as aluminum layer 80, an individual quantity of electrons 84 are ejected from aluminum layer 80 and pass into spatial region 76. Electrons 84 are adapted to form into an electron pulse and be recorded on the recording medium of their associated X-ray streak camera, by the same mechanism that photoelectrons ejected by X-rays are formed into a pulse and recorded on the recording medium, as explained above in conjunction with the discussion related to FIG. 1. Thus, in every X-ray streak camera used in the practice of this invention, a fiducial optical data record, related to fiducial optical signal 96, is recorded on the data recording medium of the X-ray streak camera. Each fiducial optical data record is recorded onto each data recording medium as the single fiducial optical signal 96 arrives at each X-ray streak camera, and at the location on each recording medium where X-ray data is then being recorded.

Figure 7:
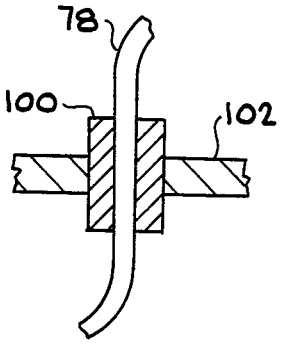
FIG. 7 is a schematic view of a vacuum interface that permits an optical fiber to be inserted through the housing of an X-ray streak camera, in accordance with the invention.

Reference is now made to FIG. 7 which is a schematic representation of optical fiber 78, which is also depicted in FIGS. 4, 5 and 6, as it passes through a vacuum interface 100 in a housing section 102 of an X-ray streak camera, such as X-ray streak camera 18 of FIG. 1. Vacuum interface 100 permits optical fiber 78 to pass from an atmospheric environment into the evacuated interior of an X-ray streak camera. Vacuum interfaces such as vacuum interface 100 are very well-known in the prior art. In general, every optical fiber of bundled array 90 of FIG. 6 is provided with a vacuum interface, such as vacuum interface 100, as it passes through the housing of its respective X-ray streak camera.

The mechanism by which an optical signal, such as signal 96, can eject electrons from an aluminum layer, such as layer 80, is presently not understood. However, it is suspected that the electrons are ejected due to a multiphoton interaction process. At any rate, the mechanism is nonlinear, increasing rapidly both for $2\omega$ and, it is believed, $1\omega$ light intensity values in excess of threshold arial power densities that are both well below the damage threshold of fused silica optical glass. This nonlinearity is very beneficial, because it causes the pulse of electrons that is ejected from the aluminum layer to have a shorter full width at half maximum amplitude than that of the driving optical signal pulse. This is an advantage because it improves the accuracy with which fiducial timing marks, as produced by this invention, may be read. In addition, it has been observed that aluminum layer 80 may be oxidized to a depth of at least 50 Angstroms, with no deleterious effect resulting to the electron ejection mechanism as described herein. Thus, after an aluminum layer, such as layer 80, is applied to an optical fiber, such as fiber 78, no precautions need be taken to prevent the exposure to the atmosphere of the aluminum layer, in conjunction with the practice of this invention.

In practice, it is suggested that the fiducial optical signed 96 be synchronized with any main laser pulse used to drive an X-ray source, such as X-ray source 10 of FIG. 1. This may be conveniently done by driving the laser oscillator of fiducial optical signal 96, and the laser oscillator of any main laser pulse, from the same rf signal generator, as is well-known in the prior art.

It is thus appreciated that in accordance with the invention as herein described and shown in the accompanying Figures, an optical fiducial timing system is provided, for use with interdependent groups of X-ray, and other, streak cameras, that may be repetitively and dependably used for long periods of time, and that produces fiducial optical data records of extremely short temporal duration.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. For use with an X-ray streak camera that comprises an X-ray photocathode and a data recording medium, and is of a type wherein during operation an X-ray beam impinges on the X-ray photocathode and thereby ejects a quantity of photoelectrons that are formed into a photoelectron pulse that records an X-ray data record onto the data recording medium, with the X-ray data record being related to the X-ray beam, a method for recording an optical data record onto the data recording medium, with the optical data record being related to an optical signal, with the optical data record being recorded on the data recording medium both as the optical signal arrives at the X-ray streak camera, and at the location on the recording medium where the X-ray data record is then being recorded, the method comprising the steps of:

coating a first end of an optical fiber with a layer of aluminum;

positioning said aluminum coated fiber end into a spatial region within the X-ray streak camera where said quantity of photoelectrons begin to be formed into said photoelectron pulse; and introducing, during operation of the X-ray streak camera, said optical signal into a second end of the optical fiber, so that the optical signal travels along the optical fiber to the first end of the optical fiber, strikes the aluminum layer and thereby ejects a quantity of electrons, from the aluminum layer, that are formed into an electron pulse that records said optical data record, that is related to said optical signal, onto said recording medium.

2. The method of claim 1, wherein said optical signal is comprised of $2\omega$, approximately 0.53 micron laser light, and has an arial power density in excess of approximately 100 $MW/cm^2$ when said optical signal strikes said aluminum layer; wherein said optical fiber is comprised of fused silica and is approximately 100 microns in diameter; and wherein said aluminum layer has a thickness in the approximate range from 50 to 200 Angstroms.

3. The method of claim 1, wherein said optical signal is comprised of $1\omega$, approximately 1.06 micron laser light, and has an arial power density in excess of approximately 200 $MW/cm^2$ when said optical signal strikes said aluminum layer; wherein said optical fiber is comprised of fused silica and is approximately 100 microns in diameter; and wherein said aluminum layer has a thickness in the approximate range from 50 to 200 Angstroms.

4. Apparatus for recording an optical data record, that is related to an optical signal, onto a data recording medium of an X-ray streak camera that comprises an X-ray photocathode and is of a type wherein during operation an X-ray beam impinges on the X-ray photocathode and thereby ejects a quantity of photoelectrons that are formed into a photoelectron pulse that records an X-ray data record, that is related to the X-ray beam, onto the data recording medium, with the optical data record being recorded on the data recording medium both as the optical signal arrives at the X-ray streak camera and at the location on the recording medium where the X-ray data record is then being recorded, the apparatus comprising:

an optical fiber having a first end and a second end, with the first end being coated with a layer of aluminum, and with the aluminum coated first fiber end adapted for being positioned into a spatial region within the X-ray streak camera where said quantity of photoelectrons begin to be formed into said photoelectron pulse; and means for introducing the optical signal into the second end of the optical fiber, during operation of the X-ray streak camera, so that the optical signal travels along the optical fiber to the first end of the optical fiber, strikes the aluminum layer, and thereby ejects a quantity of electrons that are adapted to form into an electron pulse that records said optical data record, that is related to said optical signal, onto said recording medium.

5. The apparatus of claim 4, wherein said optical signal is comprised of $2\omega$, approximately 0.53 micron laser light, and has an arial power density in excess of approximately 100 $MW/cm^2$ when said optical signal strikes said aluminum layer; wherein said optical fiber is comprised of fused silica and is approximately 100 microns in diameter; and wherein said aluminum layer has a thickness in the approximate range from 50 to 200 Angstroms.

6. The apparatus of claim 4, wherein said optical signal is comprised of $1\omega$, approximately 1.06 micron laser light, and has an arial power density in excess of approximately 200 $MW/cm^2$ when said optical signal strikes said aluminum layer; wherein said optical fiber is comprised of fused silica and is approximately 100 microns in diameter; and wherein said aluminum layer has a thickness in the approximate range from 50 to 200 Angstroms.

7. For use with an interdependent group of X-ray streak cameras, wherein each individual X-ray streak camera comprises an individual X-ray photocathode and an individual data recording medium, and wherein each individual X-ray streak camera is of a type wherein during operation an individual X-ray beam impinges on the individual X-ray photocathode and thereby ejects an individual quantity of photoelectrons that are formed into an individual photoelectron pulse that records an individual X-ray data record onto the individual data recording medium, with each individual X-ray beam being emitted by a single X-ray source, and with the individual X-ray data record being related to the individual X-ray beam, a method for recording an individual fiducial optical data record onto each individual data recording medium, with each individual fiducial optical data record being related to a single fiducial optical signal, and with each individual fiducial optical data record being recorded onto its individual data recording medium both as the single fiducial optical signal arrives at its corresponding individual X-ray streak camera, and at the location on its individual data recording medium where its corresponding individual X-ray data record is then being recorded, the method comprising the steps of:

coating a first end of each of a group of optical fibers, equal in number to the number of streak cameras of said interdependent group of X-ray streak cameras, with an individual layer of aluminum;

individually positioning each aluminum coated fiber end into an individual spatial region, within each X-ray streak camera, where each individual quantity of photoelectrons begins to be formed into each individual photoelectron pulse;

individually placing a second end of each of said group of optical fibers together into a bundled array, with said array having the characteristic of permitting a single optical signal to be commonly introduced into each second fiber end; and commonly introducing, during operation of said interdependent group of X-ray streak cameras, said single fiducial optical signal, by way of said bundled array, into each second end of each optical fiber of said group of optical fibers, so that the single fiducial optical signal travels along each optical fiber of said group of optical fibers to the first end of each optical fiber of said group of optical fibers, strikes each aluminum layer and thereby ejects an individual quantity of electrons, from each aluminum layer, that are each individually formed into an individual electron pulse that individually records one of said individual fiducial optical data records, that are each related to said single fiducial optical signal, onto one of said individual data recording media.

8. The method of claim 7, wherein said single fiducial optical signal is comprised of $2\omega$, approximately 0.53 micron laser light, and has an arial power density in excess of approximately 100 $MW/cm^2$ when said signal strikes each aluminum layer; wherein each optical fiber of said group of optical fibers is comprised of fused silica and is approximately 100 microns in diameter; and wherein each aluminum layer has a thickness in the approximate range from 50 to 200 Angstroms.

9. The method of claim 7, wherein said single fiducial optical signal is comprised of $1\omega$, approximately 1.06 micron laser light, and has an arial power density in excess of approximately 200 $MW/cm^2$ when said signal strikes each aluminum layer; wherein each optical fiber of said group of optical fibers is comprised of fused silica and is approximately 100 microns in diameter; and wherein each aluminum layer has a thickness in the approximate range from 50 to 200 Angstroms.

10. Apparatus for recording an individual fiducial optical data record, that is related to a single fiducial optical signal, onto an individual data recording medium of each individual X-ray streak camera of an interdependent group of X-ray streak cameras, wherein each individual X-ray streak camera comprises an individual X-ray photocathode and is of a type wherein during operation an individual X-ray beam impinges on the individual X-ray photocathode and thereby ejects an individual quantity of photoelectrons that are formed into an individual photoelectron pulse that records an individual X-ray data record, that is related to the individual X-ray beam, onto the individual data recording medium, with each individual fiducial optical data record being recorded onto its individual data recording medium both as the single fiducial optical signal arrives at its corresponding individual X-ray streak camera, and at the location on its individual data recording medium where its corresponding individual X-ray data record is then being recorded, the apparatus comprising:

a group of optical fibers, equal in number to the number of streak cameras of said interdependent group of X-ray streak cameras, with each optical fiber having a first end and a second end, with each first end being coated with an individual layer of aluminum, with each aluminum coated first fiber end adapted for being individually positioned into an individual spatial region, within each X-ray streak camera, where each individual quantity of photoelectrons begin to be formed into each individual photoelectron pulse, with each second end being individually placed together into a bundled array, with said array having the characteristic of permitting a single optical signal to be commonly introduced into each second fiber end; and means for commonly introducing the single fiducial optical signal, by way of said bundled array, into each second end of each optical fiber of said group of optical fibers, during operation of said interdependent group of X-ray streak cameras, so that the single fiducial optical signal travels along each optical fiber of said group of optical fibers to the first end of each optical fiber of said group of optical fibers, strikes each aluminum layer and thereby ejects, from each aluminum layer, an individual quantity of electrons that are each individually adapted to form into an individual electron pulse that individually records one of said individual fiducial optical data records, that are each related to a single fiducial optical signal, onto one of said individual data recording media.

11. The apparatus of claim 10, wherein said single fiducial optical signal is comprised of $2\omega$, approximately 0.53 micron laser light, and has an arial power density in excess of approximately 100 $MW/cm^2$ when said signal strikes each aluminum layer; wherein each optical fiber of said group of optical fibers is comprised of fused silica and is approximately 100 microns in diameter; and wherein each aluminum layer has a thickness in the approximate range from 50 to 200 Angstroms.

12. The apparatus of claim 10, wherein said single fiducial optical signal is comprised of $1\omega$, approximately 1.06 micron laser light, and has an arial power density in excess of approximately 200 $MW/cm^2$ when said signal strikes each aluminum layer; wherein each optical fiber of said group of optical fibers is comprised of fused silica and is approximately 100 microns in diameter; and wherein each aluminum layer has a thickness if the approximate range from 50 to 200 Angstroms.

* * * * *